United States Patent [19]

Paquette

[11] 4,113,293

[45] Sep. 12, 1978

[54] ADJUSTABLE DOOR LATCH STRIKER

[76] Inventor: Rolland Paquette, P.O. Box 58, (Hwy. 69 North), Val Caron, Ontario, Canada

[21] Appl. No.: 778,693

[22] Filed: Mar. 17, 1977

[51] Int. Cl.[2] ..... E05C 21/02

[52] U.S. Cl. ..... 292/341.18

[58] Field of Search ..... 292/341.18, 341.19, 292/340

[56] References Cited

U.S. PATENT DOCUMENTS

| | | | |
|---|---|---|---|
| 1,793,115 | 2/1931 | Model | 292/341.18 |
| 2,412,497 | 12/1946 | Edwards | 292/341.18 |
| 3,265,427 | 8/1966 | Williams | 292/341.18 |
| 3,395,935 | 8/1968 | Rosenberger | 292/341.18 X |

*Primary Examiner*—Richard E. Moore
*Attorney, Agent, or Firm*—W. Irwin Haskett

[57] ABSTRACT

An adjustable strike for a latch bolt of a swinging door, the strike having a face plate to be placed over an appropriate cavity and having a lip to extend into the doorway to engage and to press the latch bolt as the door closes. A flange is secured normal to the plate to extend into or beside the cavity between the plate opening and the lip. A bolt extends through the flange, preferably being threaded therethrough. A movable wall, parallel to that flange and spaced therefrom is secured to the end of the bolt and situated within the cavity behind the face plate, to be positioned within the plate opening so that the keeper surface of the latch bolt will bear against this wall when the door is closed. Longitudinal movement of the bolt and the flange causes the wall to move towards or away from the flange, thereby altering the distance between the door stop and the movable wall. The wall is moved to a distance which will provide a secure fit of the latch bolt and minimize rattling of the closed door. Such adjustable strike is readily and economically manufactured and easily installed. It greatly facilitates the hanging of a door on a door frame and subsequent adjustments required to minimize vibration of the door when closed.

8 Claims, 3 Drawing Figures

FIG. 2

ADJUSTABLE DOOR LATCH STRIKER

BACKGROUND OF THE INVENTION

This invention relates generally to an adjustable strike for receiving a latch bolt of a swinging door, and more particularly concerns a strike having a movable wall which can bear against the camming surface of the latch bolt of the door to secure the door in position against a door stop.

The latch bolt of a door normally has a beveled cam surface and a flat keeper surface, the latch bolt being spring-projected from the door but, upon exertion of a superior force, depressable into the door panel. The superior force is provided by a lip or cam, usually inclined or curved, which cams the latch bolt inwardly as the latch bolt rides over it while the door is closing. When the door is closed, the latch bolt is properly aligned opposite the opening of the strike, and the bolt springs outwardly into this opening and a cavity behind it. Door movement is limited in one direction by the stop which forms part of the door jamb and, in the other direction, by the keeper surface of the latch bolt bearing against an edge of the opening of the strike.

In hanging a swinging door having a latch bolt, great care and skill must be exercised in ensuring that the hole of the strike plate secured to the door frame, and the latch bolt projecting from the swinging edge of the door are properly aligned so that the door will be securely held against the door stop. This alignment is critical not only in the vertical direction so that the lactch bolt will fit between the upper and lower edges of the opening in the strike, but also in the lateral direction so that the door, when in closed position, with its latch bolt fully extended into the cavity of the strike, cannot vibrate and rattle between the door stop and the strike. Consequently, in hanging a door, a carpenter will often first install the strike and then, through a slow, cumbersome, difficult process of alignment, next locate the latch bolt of the door in the strike plate and then determine where the hinges of the door should be located.

Alternatively, when the door is hinged first, it is not always possible to prepare the hole beneath the strike and fasten the strike in position on the door frame with the desired degree of accuracy. Often the location of the strike must be readjusted. While this may only be a slight amount, this usually means resetting the screws.

Other times, although the door may originally be hung in proper position, through settling of the building or warping of the door or frame, the strike may become misaligned with respect to the latch bolt so that, again, the strike or the door must be adjusted accordingly.

Moreover, in climates experiencing harsh winter conditions, doorways are often insulated before each winter by securing a band of insulation material or "weatherstripping" along the doorstep particularly where the swinging edge of the door meets the doorstop. This extra strip of insulation material between the door and doorstop may be sufficient to prevent the latch bolt from reaching the hole of the strike when the door is closed, so that the strike must be re-positioned.

An adjustable strike has been described in U.S. Pat. No. 3,161,429 of Torno, et al., issued Dec. 15, 1964, in which the lip and a marginal portion of the pocket of the strike are movable towards or away from the door or door jamb to reduce the clearance between the door and latch bolt and these portions of the strike. Canadian Pat. No. 721,030 of Russell, issued Nov. 9, 1965 describes and illustrates an adjustable strike in which the tongue and a marginal portion of this pocket are adjustable in the other, lateral direction by loosening two screws set in the face of the strike for this purpose, sliding the adjustable part to the proper position, and then retightening the screws. Both strike mechanisms require the assembling of several different parts, when installing the strikes.

Other references describing and illustrating strike mechanisms adjustable in the lateral direction are Canadian Pat. No. 674,967 of Schlage, issued Nov. 26, 1963, which describes a single strike plate having a tongue or flange extending into the pocket or cavity behind the plate, the tongue being bendable to provide a secure fit for the latch bolt, and Canadian Pat. No. 863,789 of Schlage, et. al., issued Feb. 16, 1971, which describes and illustrates a circular strike having a laterally adjustable cam or lip which is secured in place by a screw. The screws of this particular mechanism, as well as the screws securing the adjustable portions of the Torno, et al. mechanism and the Russell, et al. mechanism previously referred to, are all clearly visible on the face of the plate and are operated from that direction.

The adjustable strike of Schlage, Canadian Pat. No. 863,789 and one described and illustrated in Model, Canadian Pat. No. 319,005 issued Jan. 19, 1932, have shoulders which are adjustable within the cavity behind the strike to restrict the play of the latch bolt in the strike opening. However neither of these mechanisms provides more than a shoulder or edge against which the keeper surface of the latch bolt can react when a door is closed, thus constituting an inherent weakness in each device. Also, the mechanism described and illustrated in the Model patent requires a set of tracks to guide the shoulder as it slides across the plate hole. The shoulder is adjusted by means of a bolt threaded through a flange of that shoulder, the bolt having a screw head rotatably secured in a rivet. These features add significantly to the complexity of the device and to the costs of manufacturing it.

Other references of background interest are Lundbert, Canadian Pat. No. 295,934, issued Dec. 24, 1929 and Schlage, U.S. Pat. No. 2,869,913, issued Jan. 20, 1959, both of which describe and illustrate strike mechanisms having adjustable features.

It is an object of the present invention to provide an economical, readily constructed and readily installed adjustable strike for the bolt of a swinging door which will permit easy lateral adjustment of the edge of the strike against which the keeper surface of the latch bolt bears when the door is closed, to a position which ensures a secure fit of the latch bolt and minimizes vibration or play of the closed door. It is a further object of the invention to provide an adjustable strike having secure engagement of the latch bolt in the pocket thereof. It is a further object of the invention to provide such an adjustable strike in which the adjustment mechanism is well hidden so as to provide a neat attractive appearance.

SUMMARY OF THE INVENTION

In accordance with the present invention, there is provided an adjustable strike for receiving a latch bolt of a swinging door, the strike comprising a face plate provided with an opening for receiving the latch bolt of the door when closed, for securing to a door jam over an appropriate cavity adjacent a door stop. A lip, being an extension of the face plate, extends from the doorway to engage and depress the latch bolt as the door closes. A flange is secured normal to the plate to extend into or beside the cavity between the plate opening and the lip. A bolt extends through the flange, the end of the bolt towards the lip being operatively exposed when the strike is installed. A means whereby the bolt may be longitudinally adjusted and secured in the flange is associated with the bolt. The mechanism has a movable wall parallel to the flange and spaced therefrom, adapted to be positioned within the cavity behind the face plate and positionable within the plate opening so that the keeper surface of the latch bolt will bear against this wall when the door is closed. The other end of the bolt is secured to this movable wall. Longitudinal movement of the bolt in the flange causes the wall to move towards or away from the flange, permitting alteration of the distance between the door stop and this movable wall to a distance which will provide a secure fit of the latch bolt and minimize vibration of the closed door. It is preferred that the bolt threadably engages the flange bolt and that means to rotate the bolt are associated with the end of the bolt towards the lip. The bolt may be rotatably fastened to the movable wall by securing means so that rotation of the bolt in the flange causes longitudinal movement of the bolt and movement of that wall.

An adjustable strike according to the present invention readily permits hanging of a door by placing the door on its hinges first, and then vertically locating the place in the door jamb where the cavity and strike should be positioned. When the cavity is drilled or otherwise formed and the strike is installed, the movable wall is adjusted to secure the latch bolt within the opening when the door is closed. The mechanism according to the present invention is made from simple, readily constructed parts and may be preassembled in the factory so that the carpenter or person installing the mechanism is not concerned with a multitude of loose individual parts which must be sequentially assembled. As the keeper surface of the latch bolt, when the door is closed, bears against the movable wall, greater durability of the adjustable strike and resistance to the rebound forces exerted by the latch bolt on the strike when a door is closed are achieved.

BRIEF DESCRIPTION OF THE DRAWINGS

Other objects and advantages of the invention will become apparent upon reading the following detailed description and upon referring to the drawings in which.

Figure 1:
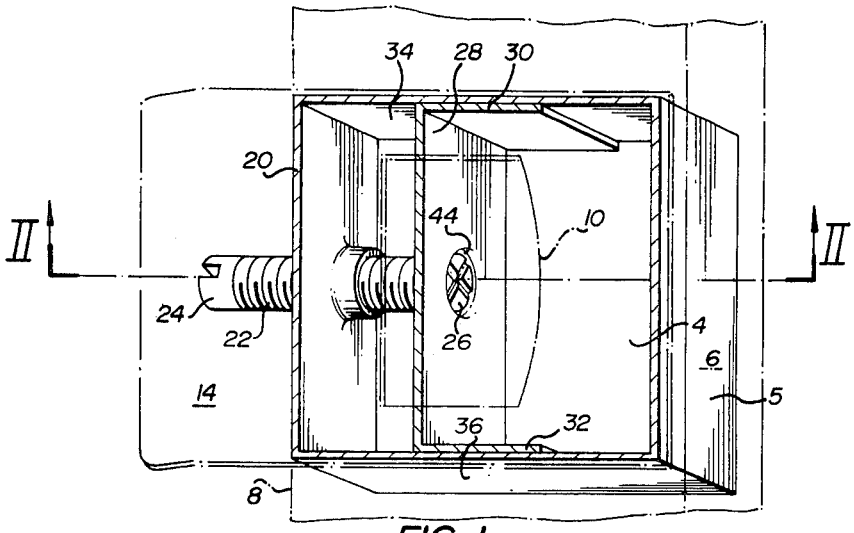
FIG. 1 is a perspective section view of an adjustable rectangular strike mechanism according to the present invention installed on a door jamb.

While the invention will be described in connection with preferred embodiments thereof, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE INVENTION

In the drawings, similar features have been given similar reference numerals.

Turning first to FIG. 1, there is shown a strike having rectangular face plate 4 and case 5 secured to door jamb 6. Door stop 8 is secured to door jamb 6 adjacent face plate 4. Face plate 4 is provided with opening 10 for receiving the latch bolt 12 (see FIG. 2) within the cavity of the jamb or the space within case 5 of the door when closed. Lip 14, being an extension of the surface of face plate 4, is provided to act as a cam for latch bolt 12 when the door 15 is closed. Latch bolt 12 has camming surface 16 and keeper surface 18. As the door closes, camming surface 16 engages and is depressed by lip 14.

Figure 2:
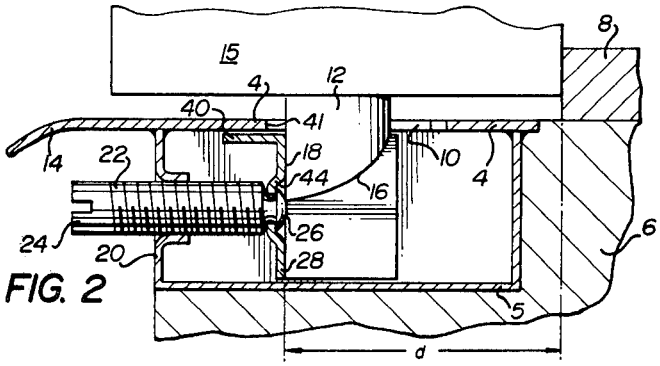
FIG. 2 is a plan section view of the mechanism of FIG. 1 taken along lines II—II.

Flange 20 is secured normal to plate 4, extending into or, as in FIG. 2, being one side of an appropriate cavity which has been formed in door jam 6 prior to installation of the strike. As can be clearly seen in FIG. 2, flange 20 is located between opening 10 and lip 14.

Bolt 22 threadably engages flange 20 and extends therethrough. The end of free end 24 of bolt 22 extends behind and is hidden by lip 14. A screw head or other appropriate rotation means is provided at this end. The other end 26 of bolt 22 is rotatably secured, by riveting, for example, to movable wall 28. Movable wall 28 is spaced from and parallel to flange 20. Rotation of bolt 22 causes the bolt to progress through or withdraw from flange 20, and causes movable wall 28 to move towards or away from this flange. As can be seen in FIG. 2, movable wall 28 is positioned within the plate opening so that keeper surface 18 of latch bolt 12 can bear against this wall when the door is closed. In other words, rotation of bolt 22 permits alteration of the distance $d$ between door stop 8 and movable wall 28 to a distance which will provide a secure fit of latch bolt 12 in the strike with no vibration of the door against stop 8. Of course when a proper distance $d$ has been achieved, bolt 22 is no longer rotated and movable wall 28 is secured in this position.

To movable wall 28 are affixed upper side 30 and lower side 32, these sides being guided by guide means, namely cooperating upper and lower sides 34 and 36 respectively of strike case 38 (or, in a simpler version, not shown, the walls of the cavity) to assit in aligning movable wall 28. Additionally, the ends of these sides, after predetermined longitudinal movement of the bolt abut against the opposite side walls of the case to stop the bolt from further rotation and prevent disengagement from flange 20. The edge of wall 28 nearest plate 4 may be rearwardly bent or have a rearwardly extending flange or wall 40 secured to it as shown in FIG. 2, parallel to and adjacent the back of face 4, so that latch bolt 16 will be guided directly to the portion of opening 10 in front of wall 28, even when this wall is positioned considerably in advance of edge 41 of opening 10. In other words, flange or wall 40 prevents latch bolt 16 from entering the cavity between movable wall 28 and flange 20.

Figure 3:
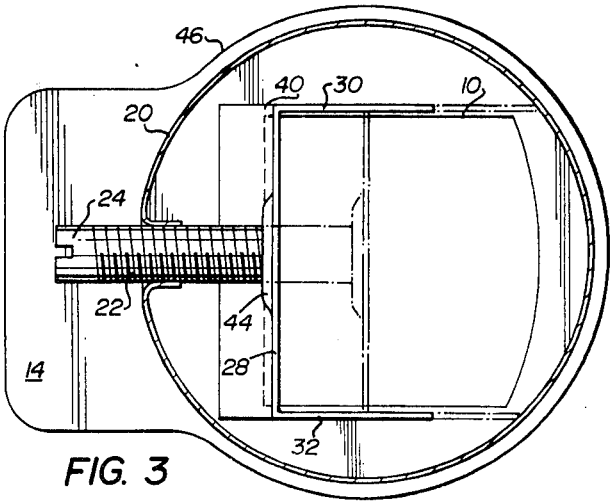
FIG. 3 is a vertical inside section of a circular strike mechanism according to the present invention.

It should be noted that the main, significant difference between the embodiment illustrated in FIG. 3 and that of FIGS. 1 and 2 is that the FIG. 3 embodiment of the invention is a strike plate having a circular face 46. This mechanism has been designed with a circular case for a cirular cavity, and hence flange 20 would normally be of circular or arcute shape. A single screw 47 at the back of the case secures the strike plate to the door jamb.

This circular version of the strike plate designed for a circular cavity, is a preferred embodiment whether the face is circular, as in FIG. 3, or rectangular (not shown), since only a drill and bit is required to make the cavity for installation. Once the proper height for the plate is found, a hole of appropriate diameter is drilled in the jamb, the plate is tapped into position, and a screw is inserted at the back of the case.

To minimize wear on riveted end 26 of bolt 22 by latch bolt 12, and to provide an even surface against which keeper surface 18 can bear, movable wall 28 has been provided with indentation 44, the indentation, of course, being in the direction of flange 20.

Thus it is apparent that there has been provided, in accordance with the present invention, an adjustable strike for receiving a latch bolt of a swinging door that fully satisfies the objects, aims and advantages set forth above. While the invention has been described in conjunction with specific embodiments thereof, it is evident that many alternatives, modifications and variations will be apparent to those skilled in the art in light of the foregoing description. For example, it is envisaged that the bolt might be longitudinally extendable through the flange and securable therein at a predetermined position using means other than the thread illustrated in the drawings. Also, stop means other than the upper and lower sides of the movable wall, such as a hexagonal headed bolt, might be provided to ensure that the bolt did not pass entirely through the flange when being rotated. It is intended to embrace all such alternatives, modifications and variations as fall within the spirit and broad scope of the appended claims.

I claim as my invention:

1. An adjustable strike for receiving a latch bolt of a swinging door, said latch bolt having a camming surface and keeper surface, the strike comprising:

a face plate, provided with an opening for receiving the latch bolt of the door when closed, for securing to a door jamb in a doorway over an appropriate cavity and adjacent a door stop;

a lip being an extension of the face plate, to extend from the doorway to engage and depress the latch bolt as the door closes;

a flange secured normal to the plate to extend into or beside the cavity between the plate opening and the lip;

a bolt extending through the flange, the end of the bolt towards the lip to be operatively exposed when the strike is installed and means whereby the bolt may be longitudinally adjusted and secured in the flange being associated with the bolt; and a movable wall parallel to the flange and spaced therefrom to be within the cavity behind the face plate, positionable within the plate opening so that the keeper surface of the latch bolt will bear against this wall when the door is closed, the other end of the bolt being secured to this movable wall, longitudinal movement of the bolt in the flange causing the wall to move towards or away from the flange to permit alteration of the distance between the doorstop and this movable wall to a distance such that the door when closed will not vibrate against the door stop, forwardly extending sides fixed to the upper and lower ends of the movable wall, these sides slidably guided by guide means to assist in aligning the movable wall, the ends of these sides, after predetermined longitudinal movement of the bolt in one direction, acting as stops by abutting against an appropriately positioned abutment member to stop the bolt from becoming disengaged from the flange by further such longitudinal movement from the flange.

2. A strike according to claim 1, wherein the face plate is of rectangular shape and is secured to the front of a circular case for a cavity of circular shape.

3. A strike according to claim 1, wherein the face plate is of circular shape and is secured to the front of a circular case for a cavity of circular shape.

4. A strike according to claim 1, wherein a bolt threadably engages the flange, means to rotate the bolt associated with the end of the bolt towards the lip is provided, said means to be operatively exposed when the strike is installed, and the bolt is rotatably fastened by securing means to the movable wall, whereby rotation of the bolt in the flange causes longitudinal movement of the bolt and movement of that wall.

5. A strike according to claim 4, wherein the bolt is rotatably riveted to the movable wall.

6. A strike according to claim 4, wherein a depression is provided on the surface of the movable wall against which the keeper surface of the latch bolt bears, where the end of the threaded bolt is secured to the movable wall, so that the end of the bolt and securing means do not interfere with the operation of the latch bolt.

7. A strike according to claim 1, wherein the bolt has a screw head.

8. A strike according to claim 1, wherein a rearwardly extending wall is secured to it, slidable parallel and adjacent the back of the face, to prevent the latch bolt from extending into the cavity between the movable wall and flange.

* * * * *